United States Patent [19]

Whiteman, Jr.

[11] 3,973,857

[45] Aug. 10, 1976

[54] GUARD RING MOUNTING FOR CEMENT FINISHER APPARATUS

[75] Inventor: Marvin E. Whiteman, Jr., Saugus, Calif.

[73] Assignee: Whiteman Manufacturing Company, Pacoima, Calif.

[22] Filed: Feb. 4, 1975

[21] Appl. No.: 547,027

Related U.S. Application Data

[63] Continuation of Ser. No. 393,803, Sept. 4, 1973, abandoned.

[52] U.S. Cl. ..... 404/112

[51] Int. Cl.[2] ..... E01C 19/22

[58] Field of Search ..... 404/112, 133; 248/22

[56] References Cited

UNITED STATES PATENTS

| | | | |
|---|---|---|---|
| 2,888,863 | 6/1959 | Eisenbeis | 404/112 |
| 2,979,996 | 4/1961 | Spitler | 404/112 |
| 3,232,188 | 2/1966 | Frohnauer | 404/133 X |
| 3,350,042 | 10/1967 | Stewart | 248/22 |
| 3,425,652 | 2/1969 | Leary | 248/22 |
| 3,756,551 | 9/1973 | Bishop | 248/22 X |

*Primary Examiner*—Nile C. Byers

*Attorney, Agent, or Firm*—Whann & McManigal

[57] ABSTRACT

Power driven cement finishing apparatus having a plurality of finishing trowel blades rotatable about a common vertical axis, a stationary guard ring being supported from a main frame structure of the apparatus so as to be positioned above and outwardly of the path of rotation of the outer end tips of the finishing blades, and vibration absorbing means being interposed between the guard ring support and the main frame structure, whereby vibrations induced in the guard ring during operation of the apparatus will be dampened and not transmitted to the finishing blades.

2 Claims, 3 Drawing Figures

GUARD RING MOUNTING FOR CEMENT FINISHER APPARATUS

This is a continuation of application Ser. No. 393,803, filed Sept. 4, 1973 now abandoned.

BACKGROUND OF THE INVENTION

The present invention relates generally to the field of power driven cement finishers.

It has heretofore been generally known in the industry to provide electric and gas engine powered cement surface finishing machines in which a plurality of trowel blades are rotated about a common vertical axis. Machines of this type are exemplified by U.S. Pat. No. 2,198,929, dated Apr. 30, 1940, wherein the rotatable trowel blades have their tip extremities interconnected by a peripherally extending ring member which is rotatable with the blades. The exposed rotating blades in these known machines created a potential dangerous hazard to the operator and other personnel and in the event that the blade connecting ring should contact an object during operative movements of the machine, undesirable surface markings could result which marred or otherwise made it difficult to obtain the desired smoothly troweled surface.

Having in mind the problems of the known machines, as noted above, it is contemplated in the present invention to provide a stationary guard ring and supporting structure which will shield the rotating blades from inadvertent contact by operating and other personnel, and which will premit the machine to be moved into close areas where the guard ring might strike an object, but without causing the undesirable surface effects as would be produced by the heretofore known machines having a movable ring connected at the trowel tip ends.

In the development of the stationary guard ring concept, it was discovered that, when the ring support was connected directly to the main frame of the machine, there was a tendency for vibrations to be induced in the ring structure, and that these vibrations were conducted to the trowel blades. An undesirable condition was thus produced in that the vibrations of the blades were reflected in the form of ripples in the cement surface. It was therefore more or less impossible to obtain the desired smooth surface finish. This problem was overcome in the present invention by placing vibration absorbing means between the ring structure and the main frame structure of the machine.

SUMMARY OF THE INVENTION

The present invention relates generally to power driven cement finishers, and is more particularly concerned with the provision of a stationary guard ring structure, and especially a guard ring structure having a vibration absorbing mounting.

It is one object of the herein described invention to provide in a power driven cement surface finisher, a stationary guard ring for the rotatable trowel blades.

A further object is to provide a cement surface finishing machine according to the foregoing object, wherein the guard ring structure has a support containing vibration absorbing means, so as to thereby prevent operating vibrations induced in the guard ring from being transmitted to the trowel blades.

Another object is to provide an improved mounting for a stationary guard ring in a cement surface finishing machine, in which the ring supporting frame structure is mounted on a plurality of resilient grommets carried by the main frame structure of the machine.

Further objects and advantages of the invention will be brought out in the following part of the specification, wherein detailed description is for the fully of fuly disclosing a perferred embodiment of the invention without placing limitations thereon.

BRIEF DESCRIPTION OF THE DRAWINGS

Referring to the accompanying drawings, which are for illustrative purposes only.

DESCRIPTION OF A PREFERRED EMBODIMENT

Figure 1:
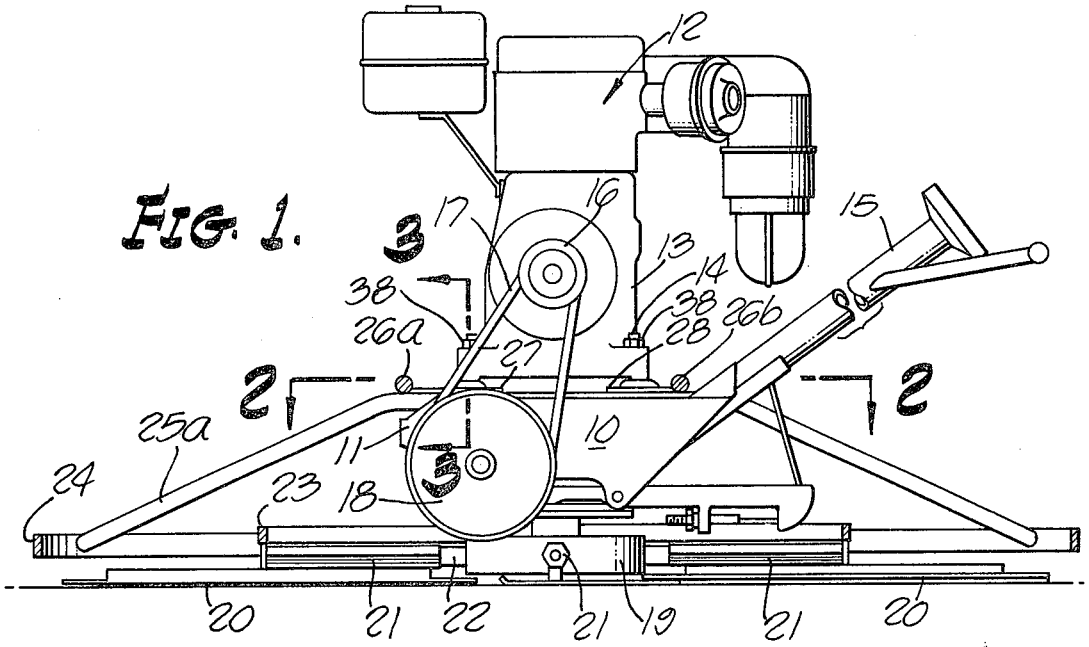
FIG. 1 is a side elevational view, partly in section, of cement finishing apparatus embodying the features of the present invention.

Referring more particularly to the drawings, for illustrative purposes, the invention is shown in FIG. 1 as being embodied in cement surface finishing apparatus in which a main frame structure 10 is connected with a gear box 11 upon which there is mounted a suitable source of power such as a gasoline engine 12, this engine having a base structure 13 secured to the gear box as by appropriate stud bolts 14. A guiding handle 15 extends from the main frame structure and provides means for the operator to control the movements of the apparatus over the surface which is being finished.

A drive pulley 16 of the engine is coupled through a driving belt 17 with a driven pulley 18 of the gear box 11 which is arranged to rotate at reduced speed on a vertical axis an underlying circular support 19. A plurality of trowel plates 20 are equally spaced around and extend radially outwardly from the circular support 19. These trowel plates are respectively supported from an associated overlying shaft 21 having its innermost end mounted in a suitable bearing 22 on the support 19, and its outer end rotatably supported from a ring member 23 having concentric relation with respect to the circular support 19. The shafts 21 of the respective trowel plates are connected with means for adjustably applying partial rotational movements to the shafts so as to adjustably tilt the troweling blades to desired angles of operation, when desired.

The cement finishing apparatus as thus far described is of known conventional construction, and as so arranged it will be appreciated that the rotating trowel blades 20 present a potentially dangerous hazard to the operator as well as other personnel. In addition, the operator must exercise continuous attention and care in order to assure that the moving blades do not come in contact with any stationary objects in the area being worked in order to avoid damage to the blades or movements of the apparatus in such a manner that the blades would dig into the cement surface and produce an uneven rather than smooth finish.

The improvement according to the present invention resides in the provision of a stationary guard ring structure in which a guard ring 24 is supported in concentric relation to the circular support 19 in a position above and outwardly of the path of rotation of the outer end tips of the finishing blades 20. As best shown in FIGS.

Figure 2:
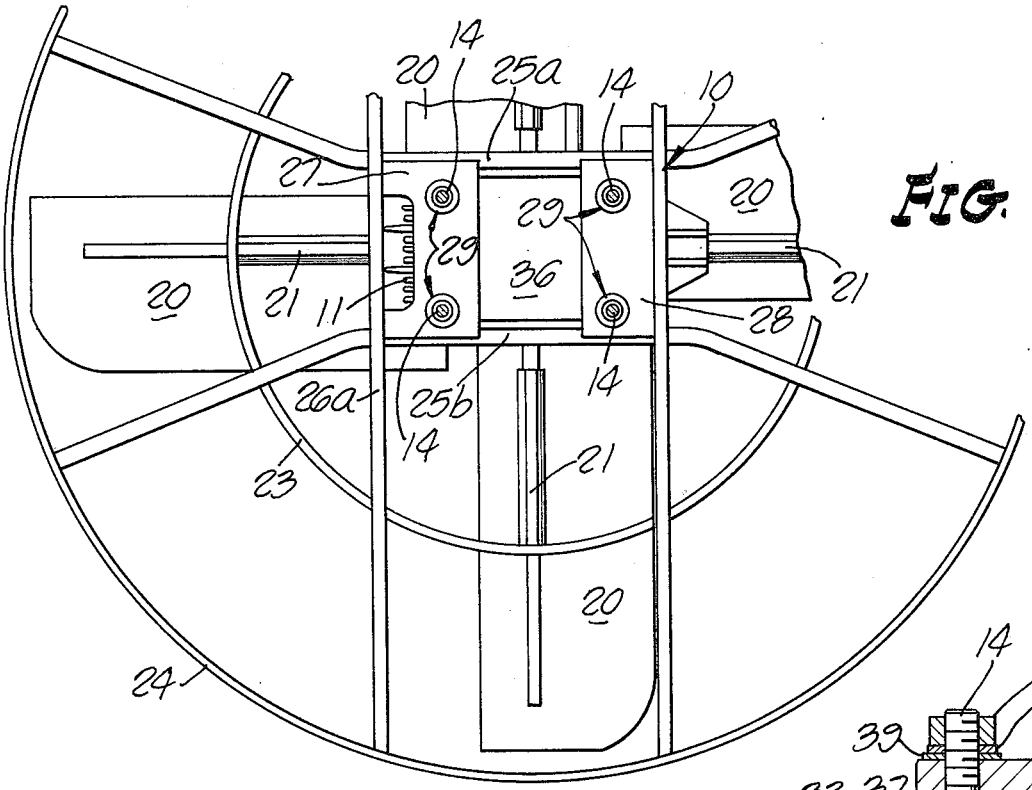
FIG. 2 is a fragmentary sectional view taken substantially on line 2—2 of FIG. 1, and showing details of the guard ring and its supporting structure.

1 and 2, the ring 24 is supported at the periphery of a frame structure formed by a plurality of spaced rod members 25*a*–25*b* and 26*a*–26*b*. The rod members are welded or otherwise secured together in a manner to form a central frame portion of rectangular configuration, and from which the rods are downwardly deflected so as to support the ring 24 in an underlying plane adjacent the outer ends of the troweling blades. As shown in FIG. 2, mounting plates 27 and 28 are secured respectively at the opposite ends of the rectangular frame portion for use in supporting the ring 24 and its associated frame structure from the main frame of the apparatus.

Each of the plates 27 and 28 contains a pair of spaced resilient mounting assemblies 29—29 which resiliently support the ring frame structure and provide vibration absorbing means between the ring and main frame structure which will dampen out and prevent the transmission of any vibrations which may be induced in the ring during operation of the apparatus and prevent transmission of these vibrations to the finishing blades 20.

Figure 3:
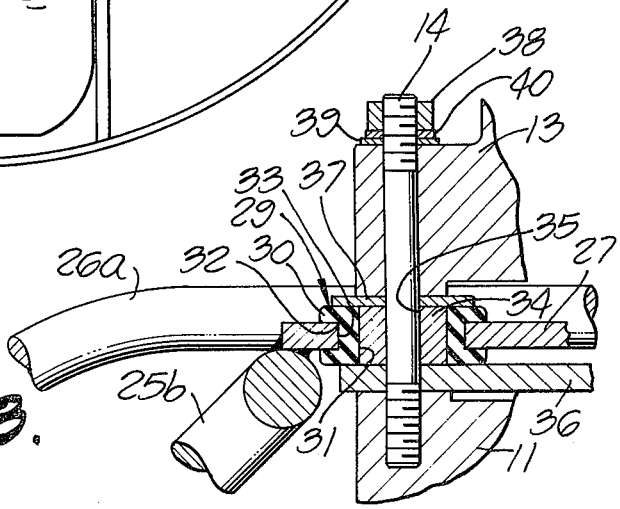
FIG. 3 is an enlarged fragmentary sectional view taken substantially on line 3—3 of FIG. 1, and showing details of the vibration supporting means in the mounting of the ring support structure.

As shown in FIG. 3, each mounting assembly 29 comprises a cylindrical grommet 30 of rubber or other suitable resilient material, this grommet having a central axial bore 31 and an outer circumferentially extending groove 32 for receiving the marginal portions of an opening 33 formed in the associated mounting plate 27 or 28. The bore 31 of the grommet surrounds a tubular spacer member 34 having a central axial bore 35. It should be noted that the axial length of the spacer 34 is less than the initial axial length of the grommet 30.

The grommet and spacer are mounted in each case on one of the stud bolts 14 between the engine base structure 13 and the gear box 11 which threadedly receives the lower end of the stud bolt 14. A main frame mounting plate 36 extends between the mounting plates 27 and 28 and is interposed between the lower end of the spacers 34 and the gear box, this plate being held in position by the stud bolts 14. A washer 37 is interposed between the upper end of the spacer and the associated portion of the engine base structure 13. The uppermost end of the stud bolt is threadedly engaged by a suitable nut 38, and if desired a flat washer 39 and lock washer 40 may be placed under the nut.

With the mounting assembly as described above, it will be seen that, when nuts of the stud bolts are tightened down, compressive forces will be applied at the ends of the grommets to conform their axial length to that of the axial length of the spacer members. Thus, a rigid mounting connection is established between the main frame mounting plate 36, the gear box 11 and the engine base structure 13, while at the same time establishing a resilient mounting for the mounting plates 27, 28, together with the guard ring 24 and its associated supporting frame structure.

From the foregoing description and drawings, it will be clearly evident that the delineated objects and features of the invention will be accomplished.

Various modifications may suggest themselves to those skilled in the art without departing from the spirit of my invention, and, hence, I do not wish to be restricted to the specific forms shown or uses mentioned, except to the extent indicated in the appended claims.

I claim:

1. In cement finishing apparatus having a main frame structure operatively mounting a plurality of rotatable finishing trowel blades, and power driving means having a mounting base portion, the improvement comprising:

a. an upper plate member rigidly supported on said main frame;

b. means for rigidly supporting the power means on said main frame with its base portion in spaced relation to said upper plate member, including a plurality of tubular spacer members respectively receiving an anchor stud bolt;

c. a guard ring for said finishing blades carried by the outer ends of circumferentially spaced rod members, said rod members at their inner ends being connected with a central plate means positioned in the space between said power means base portion and said upper plate member, and having enlarged openings for respectively coaxially surrounding said spacer members; and d. a plurality of axially compressed cylindrical grommets of resilient material respectively having a central bore grippingly engaged around one of said spacer members and an outer peripheral groove intermediate its ends for grippingly receiving and engaging the marginal edge portion of the central plate means forming the associated opening, whereby the central plate means, rod members and guard ring are resiliently supported with respect to said main frame, and vibrations induced in said guard ring during operation of the apparatus will not be transmitted to the finishing blades.

2. In cement finishing apparatus having a main frame structure operatively mounting a plurality of finishing trowel blades for rotation with respect to a common vertical axis, said main frame having a rigidly connected upper mounting plate, and a connected power means having a base portion, the improvement comprising:

a. means for rigidly supporting the power means with its base portion in spaced relation above said mounting plate, comprising:

a plurality of spaced apart tubular spacer members positioned in the space between said power means base portion and said mounting plate, a plurality of mounting stud bolts for securing the power means base portion, which respectively extend through said spacer members;

b. a non-rotatable guard ring positioned above and outwardly of the path of rotation of the outer end tips of the finishing blades, said guard ring being carried at the periphery of frame members extending outwardly from a central plate means positioned in the space between said power means base portion and said mounting plate, said central plate means having relatively larger openings respectively surrounding said spacer members; and c. means for supporting said guard ring including vibration absorbing means for mounting and supporting said central plate means in the space between the power means base portion and the mounting plate, whereby vibrations induced in said ring during operation of the apparatus will not be transmitted to the finishing blades, comprising:

an axially compressed cylindrical grommet of resilient material grippingly surrounding each of said spacer members, said grommet having an outer peripheral groove for grippingly receiving the adjacent marginal edge portion of the associated central plate means forming said opening.

* * * * *